United States Patent [19]

Lo

[11] 4,193,277

[45] Mar. 18, 1980

[54] LOCK BODY WITH LOCKING PINS OPENED OR CLOSED BY THE CYLINDRICAL KEY BAR

[76] Inventor: Jiuan P. Lo, 30-1, Lane 325, St., Tong Ho,Taipei City, Taiwan

[21] Appl. No.: 876,043

[22] Filed: Feb. 8, 1978

[51] Int. Cl.[2] ..... E05B 15/14; E05B 19/02; E05B 27/06; E05B 27/10

[52] U.S. Cl. ..... 70/358; 70/364 A; 70/378; 70/403

[58] Field of Search ..... 70/358, 364 R, 364 A, 70/376, 377, 378, 386, 403, 419, 453, 454

[56] References Cited

U.S. PATENT DOCUMENTS

| | | | |
|---|---|---|---|
| 2,093,925 | 9/1937 | Pickop | 70/403 |
| 3,486,353 | 12/1969 | Pilvet | 70/419 |
| 3,541,822 | 11/1970 | Murphy | 70/386 |

*Primary Examiner*—Robert L. Wolfe
*Attorney, Agent, or Firm*—Cushman, Darby & Cushman

[57] ABSTRACT

A cylindrical lock with tumbler and driver pins opened or closed by a cylindrical key in which a cylindrical plug is provided with one row or several rows of "ϕ"-shaped tumbler pins and the lock body is provided with corresponding driver pins of diversified shapes in equivalent rows. When the lock is closed, the driver pins brake the cylindrical plug at the lock body and thus cannot be rotated. In order to open the lock, the cylindrical key bar is inserted in the key hole of the plug. The key bar is formed with grooves of suitable angle. When the cylindrical key bar is rotated in the key hole, the grooves on the key bar will back up the "ϕ"-shaped tumbler pins to the periphery of the plug while pushing the driver pins from the plug into said lock body to make the plug free from said lock body. The cylindrical key bar with special designed angled grooves will apply pressure to the "ϕ"-shaped tumbler pins engaging with said plug so as to actuate the lock latch. Outside the plug, lock body and the diversified driver and tumbler pins of said lock, one set of protecting ring and protecting plate is provided to hide the plug within said lock body to make no forcible points therein so as to reduce the possibility of opening by the thief.

9 Claims, 13 Drawing Figures

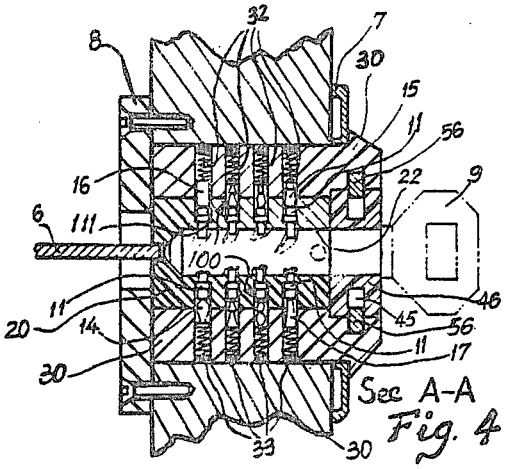
Sec A-A
Fig. 4
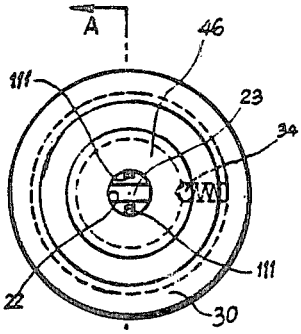
Fig. 3
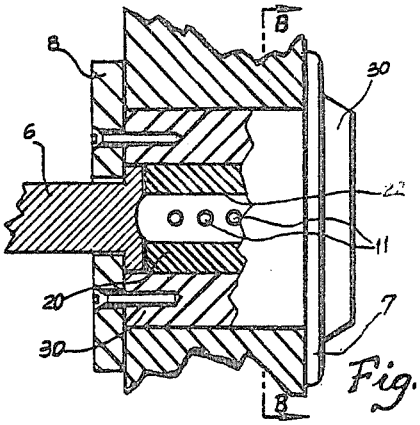
Fig. 5
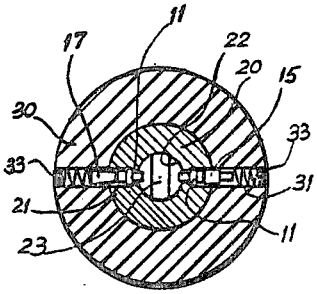
Sec. B-B
Fig 6
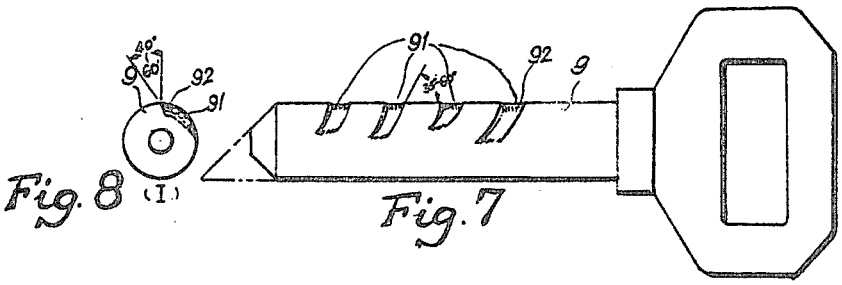
Fig. 8 (I)
Fig. 7
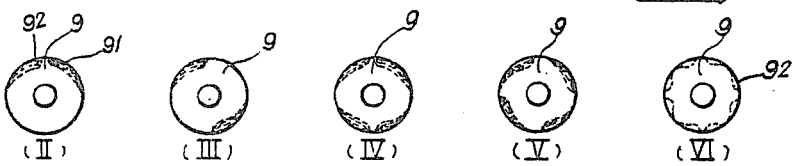
Fig. 8

LOCK BODY WITH LOCKING PINS OPENED OR CLOSED BY THE CYLINDRICAL KEY BAR

BACKGROUND OF THE INVENTION

The conventional lock is made mechanically. As the mechanical structure within the lock means is simple, without the complex and diversified mechanism, the conventional lock is thus easily opened either by master key or by trial and error. The present invention has overcome this defect and improved upon the conventional lock with a lock in which a cylindrical lock body with pins is opened or closed by the cylindrical key bar.

SUMMARY OF THE INVENTION

The object of the present invention is to provide a lock having cylindrical lock body with pins opened or closed by a cylindrical key bar when the conventional mechanical opening means would not open said lock.

The present lock comprises a cylindrical lock body, cylindrical plug (lock core) a, protecting ring, a protecting plate and several locking pins having diversified shapes. The lock body and lock core are respectively and correspondingly provided with drivers and tumblers (lock pins) arranged in corresponding rows thereon. When the lock is closed, the drivers (locking pins brake the lock core at the lock body and thus can not be rotated and opened. In order to open the lock, the correct cylindrical key bar is inserted into the key hole of the lock core. The key bar is formed with grooves of suitable arc. Whenever rotating the cylindrical key bar, the grooves on the key bar will back up the tumblers ("ϕ" shaped locking pins) which, in turn, push the locking pins extended from the lock body and inserted into said lock core so as to push the lock pins onto/around the circumference of lock core, i.e., the outer end of said "ϕ" shaped locking pins will stop at the circumference of outside diameter of said lock core. The lock core will be free from said lock body. Said cylindrical key bar with the specially designed grooves will make the "ϕ" shaped locking pins engaging with said lock core so as to actuate the lock latch.

The locking pins of the present invention have several shapes such as: "ϕ" shapes, double-cone shape, tumbler shape, peach shape, extending shape, cylindrical shape and conical shape. The lock core are made of "ϕ" shape for easier reciprocating motion within said core. However, the locking pins extended from said lock body are diversified with several shapes. Hence, the diversified pins of the lock body cooperating with the "ϕ" shaped pins within said lock core will confuse the thief's trial for opening said lock by using the conventional mechanical means.

After putting the lock core into said lock body, the protecting ring and protecting plate is hidden and fixed deeply. The key hole of said lock core is circular in shape and is further provided with protecting ring so that the thief can not find out the forcible points to open said lock. The present lock is designed without forcible points to completely prevent from opening.

BRIEF DESCRIPTION OF THE DRAWINGS

FIG. 3 is the front view drawing of the present invention.

FIG. 4 is the A—A sectional drawing of the present invention.

FIG. 5 is the tope view drawing of the present invention.

FIG. 6 is the B—B sectional drawing of the present invention.

FIG. 7 is the drawing of cylindrical key bar of the present invention.

FIG. 8 is the side view drawing of several cylindrical key bars of the present invention. (I–VI).

DESCRIPTION OF THE PREFERRED EMBODIMENT

Figures 1, 2:
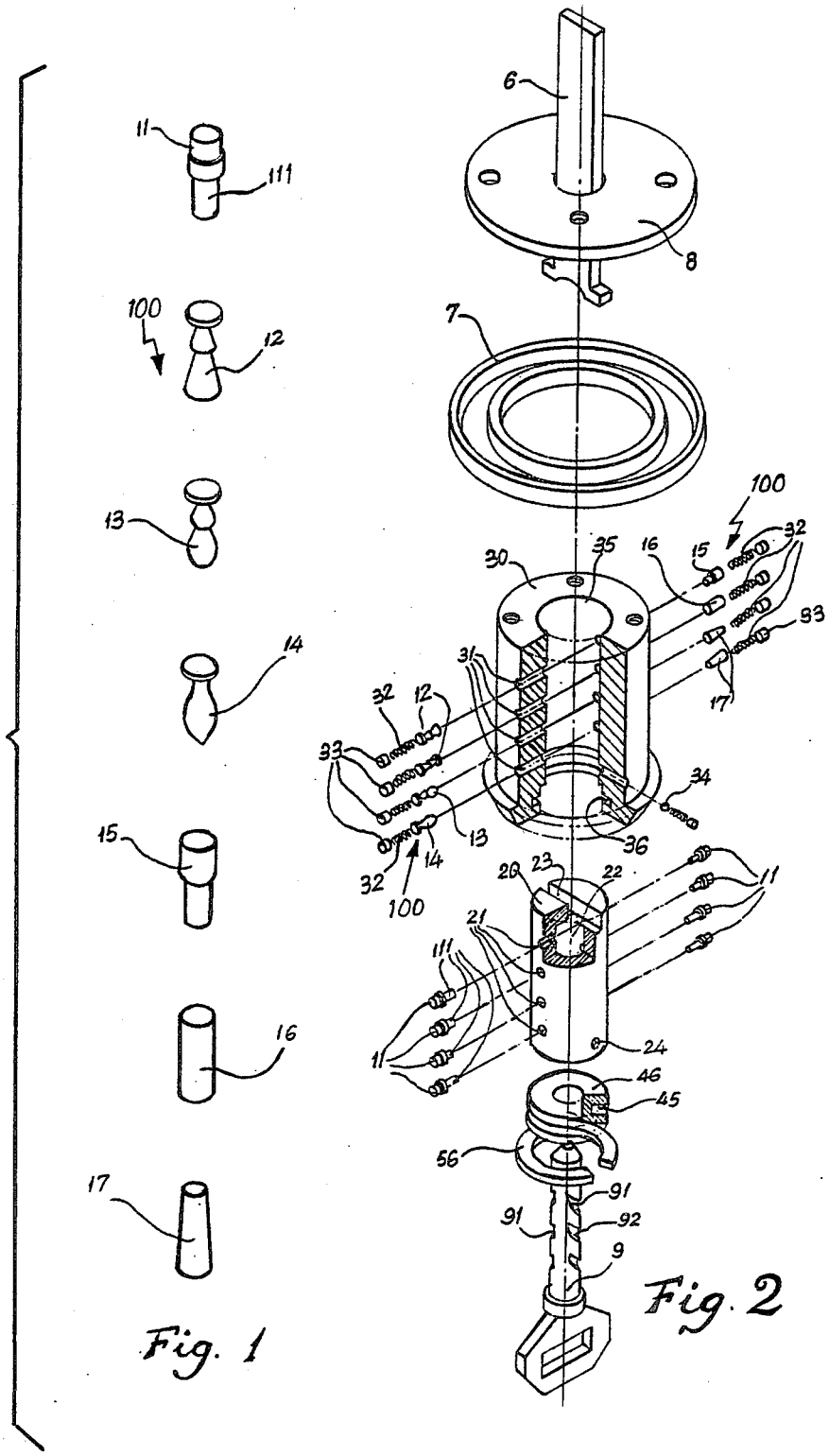
FIG. 1 is the drawing of several kinds of locking pins in accordance with the present invention.
FIG. 2 is the perspective drawing of the separated parts of the present invention.

As shown in FIG. 1, the drivers and tumblers (locking pins) of the present invention have "ϕ" shape 11, double-cone shape 12, tumbler shape 13, peach shape 14, extending shape 15, cylindrical shape 16 and conical shape 17.

As shown in FIG. 2, the tumbler ("ϕ" shaped locking pin) 11 and extending shape pin 15 are suitable in the pin hole 21 of said plug (lock core) 20. The pin hole 31 of lock body 30 is suitable for the insertion of several drivers (locking pins with diversified shape) collectively designated by the numeral 100. With the aid of spring 32 and plunger 33, the driver (locking pin) 100 within the pin hole 31 will extend into the core hole 35.

The arrangement of said locking pins in said lock body 30 and lock core 20 may be one row through four rows. The allocation of locking pins of each row arrangement may be irregular and diversified as being commensurate with the cylindrical key bar 9.

The lock core 20, except several pin hole 21, is provided with key hole 22 centrally. The hole is not drilled thoroughly. The end portion of said lock core is provided with groove 23 to drive the lock tongue 6.

The front edge on said lock core 20 is provided a recessed hole 24 so as to engage with the abrupted steel ball 34 when rotating the lock core 20 within the lock body 30 to express the sharp locking situation.

The front portion of core hole 35 of said body 30 is made with bigger diameter and provided with a deep groove 36. When inserting the lock core 20 into the lock body 30, the protecting ring 46 is put into said front portion. The ring spring 56 originally pressed within the groove 45 of ring 46 will open to engage with said groove 35 for permanent fixation and protection.

A lock tongue 6 behind the lock body 30 is fixed with fixation pan 7 and protecting plate 8. Said protecting plate 8 is drilled with four holes and is fixed onto lock 30 by screws.

As shown in FIGS. 7 and 8, the cylindrical key bar 9 is made of either deep or shallow grooves 91 with diversified designs which are commensurate with the lengthy or shorter actuation section 111 on said "ϕ" shaped locking pin 11. The arrangement rows of key groove 91 will be in accordance with the rows of locking pins 11 and 100. With single row of locking pins 11 and 100, the key grooves 91 on said cylindrical key bar 9 may be single row or double rows. With single row of key groove 91, it can be operated in single direction. For double key grooves 91, it can be operated in two directions. By this principles, when the lock body having two rows or four rows of locking pins, the key groove 91 on said cylindrical key bar 9 may by formed as two rows, four rows, eight rows, etc. Hence, its diversified and complex structure is helpful for safer protection.

The foregoing key grooves 91 are designed to extend toward the end of said key bar at an angle in the range 35 to 60 degrees between the direction of the groove 91 and the longitudinal axis of the key bar 9. When inserting the cylindrical key bar 9 into key hole 22, the cylindrical key bar 9 can be rotated to slip the actuation portion 111 of said "ϕ" shape locking pin 11 onto the actuation point 92 in key groove 91. The depth of groove 91 is commensurate with the length of actuation portion 111 of locking pin 11 so that the "ϕ" shaped locking pin 11 will not exceed the pin hole 21 of lock core 20 and the diversified locking pins 100 within said lock body 30 are pushed to allow the "ϕ" shaped locking pins 11 of core 20 to intersect with the diversified locking pins 100 at the periphery of lock body 30 thereby allowing the lock core 20 to rotate unobstructed by "ϕ"-shaped locking pins 11 of the diversified locking pins 100. The rotation of said cylindrical key bar 9 will cause a side of groove 91 to intersect the "ϕ"-shaped locking pin 11 at an actuation point 92 since the groove 91 is at a non-perpendicular angle to the axis of rotation (the longitudinal axes of the lock core 20 and the key bar 9). Continued rotation of key bar 9 will cause pressure to be exerted by the side of groove 91 at actuation point 92 to the side of "ϕ"-shaped locking pin actuation portions 111 to rotate the pins 11, drive the "ϕ" shaped locking pin 1 through the actuation point 92 and accordingly drive the core 20 and lock tongue 6 for opening the lock latch.

When locking the lock, the cylindrical key bar 9 may be rotated to rotate the lock core 20. As the recessed hole 24 meeting the abrupted steel ball 34, the feeling may be responded as the ball 34 engaging with the hole 24. This means that the cylindrical key bar 9 has reached the sharp position and the "ϕ" shape locking pins having coincided with the locking pins within said lock body. At this time, said cylindrical key bar 9 may be drawn out easily.

After drawing out said key bar 9, the "ϕ" shape locking pin 11 would not be further pressed by said bar 9. The spring 32 within the lock body 30 will enforce the locking pin within body 30 and said shape locking pin 11 onto the central core hole. The diversified locking pins 100 within said lock body 30 brake and engage within the boundary between said core 20 and body 30 so as to become a dense closing state which can not be easily opened. (As shown in FIGS. 4 and 6)

From the above-mentioned specification, it is clear to understand that the present locking pins having diversified structures and causing confusion and complexity for difficult opening the lock. The key hole is made circular without forcible point. With additional protection by protecting ring and the diversified arrangements of locking pins, the present invention is found novel and practical.

I claim:

1. A cylindrical lock comprising:
a housing;
a cylindrical plug mounted for rotation in said housing;
a roll-back mounted for rotation with said plug;
tumbler means disposed in said plug for opening and closing said lock;
cylindrical key bar means for aligning said tumbler means at the periphery of said plug;
said bar means including a cylindrical bar having angled grooves in the periphery thereof corresponding to said tumbler means;
said tumbler means being responsive to pressure applied by the sides of said grooves when said key bar means are rotated in said plug to rotate said plug and said rollback.

2. A cylinder lock comprising:
a housing;
a rotationally mounted cylindrical plug within said housing, said plug having a front surface and a peripheral surface;
said housing having a surface with a plurality of indentations adjacent the periphery of said plug;
said cylindrical plug periphery having a plurality of openings extending radially therein, each of said plurality of openings corresponding to one of said plurality of indentations and radially aligned therewith;
biased tumbler means, disposed in each of said corresponding openings and indentations, for locking said plug against rotation;
said tumbler means including a plurality of tumblers having inner and peripheral ends, and having actuation portions of diversified length disposed in said openings;
a cylindrical key bar slidably insertable in said plug through said front end, said bar having a plurality of grooves in the periphery thereof, each of said plurality of tumblers corresponding to one of said plurality of grooves;
said plurality of grooves being arranged to receive therein said corresponding tumbler inner end;
each of said plurality of grooves extending non-perpendicularly to the longitudinal axis of said key bar and having an actuation point along one side surface of said each groove such that said corresponding tumbler peripheral end will be pressed against said one side surface at said actuation point of said each groove to apply a force thereto when said key bar is turned; and
each of said plurality of grooves having such depth adjacent to said actuation point that said corresponding tumbler peripheral end is aligned relative to said periphery of said plug to release said plug for rotation so that said force causes said plug to rotate.

3. A cylinder lock as in claim 2, wherein said biased tumbler means further comprises a plurality of spring biased drivers having diversified side contours disposed in said housing indentations, said plurality of drivers having inner and peripheral ends, said driver peripheral ends abutting said tumbler peripheral ends.

4. A cylinder lock as in claim 2 or claim 3 further comprising a roll-back mounted to said plug for rotation therewith, a protective plate mounted to said housing and having a hole for receiving said roll-back therethrough, and a protection ring mounted to said housing and surrounding said plug front surface.

5. A cylinder lock as in claim 3, wherein said plurality of drivers consist of pins having uniform length, diversified contours, and cylindrical peripheral ends; and
each of said plurality of tumblers consists of a tumbler pin having a cylindrical peripheral end and a cylindrical actuation portion.

6. A cylinder lock as in claim 5, wherein said plurality of plug openings are arranged in between one and four rows of three of more of said openings, said rows being parallel aligned with the longitudinal axis of said cylindrical plug.

7. A cylinder lock as in claim 5, wherein each of said plurality of key bar grooves is extended at an angle to the longitudinal axis of said key bar of between 35° and 60° and has a depth corresponding to the length of said actuation portion of said corresponding tumbler wherein said corresponding tumbler is a corresponding tumbler pin.

8. A cylinder lock as in claim 7 wherein said plurality of grooves are arranged with two rows of grooves for each row of plug openings so that said lock may be opened or closed by rotating said key bar in either direction.

9. A cylinder lock as in claim 5 further comprising a spring biased ball disposed in said housing intersecting the periphery of said cylinder plug, said plug having a hole, said hole being arranged so that said ball extends into said hole when said corresponding driver pins and tumbler pins are rotated into alignment.

* * * * *